US006390514B1

(12) United States Patent
Frolov

(10) Patent No.: US 6,390,514 B1
(45) Date of Patent: May 21, 2002

(54) EXIT DOOR LATCH ASSEMBLY

(75) Inventor: George Frolov, Farmington, CT (US)

(73) Assignee: Harrow Products, Inc., Grand Rapids, MI (US)

( * ) Notice: Subject to any disclaimer, the term of this patent is extended or adjusted under 35 U.S.C. 154(b) by 0 days.

(21) Appl. No.: 09/411,094

(22) Filed: Oct. 4, 1999

(51) Int. Cl.[7] ..... E05B 65/10
(52) U.S. Cl. ..... 292/92; 292/341.15; 70/92
(58) Field of Search ..... 292/92, DIG. 65, 292/340, 341, 341.11, 341.12, 341.13, 341.15; 70/92

(56) References Cited

U.S. PATENT DOCUMENTS 3,149,864 A * 9/1964 Foster
3,449,006 A * 6/1969 Petri ..... 292/341.15 X
3,663,047 A * 5/1972 Zawadzki ..... 70/92 X
3,767,238 A * 10/1973 Zawadzki ..... 292/92 X
4,545,606 A * 10/1985 Vodra ..... 292/92

* cited by examiner

*Primary Examiner*—Teri Pham Luu
(74) *Attorney, Agent, or Firm*—Alix, Yale & Ristas, LLP

(57) ABSTRACT

A latch assembly comprising a latch frame mounted to a door. A latch bolt is mounted to the latch frame for pivotal movement between a biased position extended position and a retracted position. The latch bolt includes a tip portion with opposing planar locking and shaped engagement surfaces. A link is pivotally mounted to the frame for movement between a biased blocking position and a release position. In the blocking position the link prevents movement of the latch bolt from the extended position. A push bar pivots the link to the release position in response to an applied force. A frame bolt is mounted to a door frame for linear displacement between a position projecting from the door frame and a position displaced toward the door frame. The frame bolt includes opposing engagement and planar locking surfaces. When the door is closed the planar locking surfaces are in opposing surface-to-surface contact securing the door to the frame.

18 Claims, 8 Drawing Sheets

EXIT DOOR LATCH ASSEMBLY

BACKGROUND OF THE INVENTION

This invention relates generally to a latch assembly which functions to latch a door to a door frame. More particularly, the present invention relates to latch assemblies which are employed in conjunction with exit bars to latch the exit door to the door frame.

Conventional latch technology to which the invention relates typically focuses on a door latch bolt which is projectable and retractable to provide the latching/unlatching function. The specific latch bolt operation and configuration is typically a compromise between durability, reliability and security considerations. For example, latch bolts which linearly slide and project into an associated strike of a door frame provide a high degree of latch security. However, this type of latch bolt is susceptible to wear due to the sliding interaction and consequently presents reliability concerns. In other applications, the latch bolt rotates or pivots into engagement with the corresponding door strike. While the pivoting motion of the latch bolt reduces the frictional wear characteristics normally associated with the sliding-type latch bolts, the tapered or contoured surface required for pivotal engagement provides a depth of engagement within the door strike which is somewhat easy to defeat and, consequently, does not provide an optimum level of security. Because of the intensive usage that exit bars and exit doors generally experience, especially in public facilities, exit bars ordinarily adopt the rotary-type latch bolt, compromising increased security for lessened wear.

While it is certainly possible to provide a door latch mechanism which has both rotary and slidable operative features, thereby optimizing both the wear and security characteristics, such a door latch mechanism requires a number of moving parts and can be relatively expensive to manufacture.

In addition, there are regulatory codes governing door opening specifications which must be met. These codes specify relatively small force requirements for door latching and unlatching. Typically the latch bolt requires an angled or beveled bolt geometry to retain reliable functionality given these mandated force requirements. The angular geometry chosen is a compromise however. As the angle increases, for example, the force required to retract the latch bolt decreases due to the increase in the resulting tangential force applied to the bolt. However, by incorporating a relatively large angle, when the door is heavily loaded, the strike and door tend to separate. This leads to the door opening under substantially large loads and resulting in an unsecured condition. At the other extreme, if there is no angle placed on the latch bolt, the door and strike are not prone to disengage, but the forces needed to retract the latch bolt are significant and may exceed those specified by code. Consequently, the purely linear retraction required for a latch bolt with no angle is ordinarily not desirable to meet the mandated door opening force requirements.

SUMMARY OF THE INVENTION

Briefly stated, the invention in a preferred form is a latch assembly for an exit door. A latch frame mounted to the secured side of a door includes a latch cover which defines a latch face opening. A latch bolt is mounted to the frame for pivotal movement between a position wherein a tip portion of the latch bolt projects from the opening, and a position wherein the tip portion is retracted. The tip portion includes a planar locking surface and an opposing curved or beveled engagement surface. The latch bolt is biased toward the extended position by a torsion spring. The latch bolt is secured in extended position by engagement with a blocking link mounted within the latch frame.

Preferably, the blocking link comprises a crank having first and second ends. The crank is pivotally mounted to the latch frame at a crank axis intermediate the crank ends. A force applied to the first crank end, such as by an exit bar, causes the crank to pivot out of engagement with the latch bolt, thereby allowing the latch bolt to rotate toward the retracted position.

A frame bolt is mounted to the door frame in opposing relationship with the latch bolt when the door is closed within the door frame. The frame bolt is biased away from the door frame to a projected position and displaceable towards the door frame. The frame bolt includes a planar locking surface and an opposing engagement surface which is preferably curved or tapered.

Preferably, the frame bolt is displaceably mounted in a plunger assembly, which is in turn mounted to the door frame. The plunger assembly may include a lock pin displaceably mounted adjacent the frame bolt locking surface for movement between a biased position projecting from the door frame and a position inward of said projected position toward the door frame. When the lock pin is in the projected position, the frame bolt is free to move toward the inward position. When the lock pin is displaced inwardly, the frame bolt is fixed in the projected position.

A jamb plate may be mounted to the door frame. The jamb plate spans the distance between the door frame and the latch cover when the door is closed. The jamb plate functions to cover the latch bolt when the door is in the closed position and as a guard when the door is in the open position.

When the door is in the closed position, the latch bolt is prevented from moving by the blocking link. The frame bolt may be prevented from moving by the lock pin in some embodiments. The latch bolt and frame bolt planar locking surfaces are in opposing surface-to-surface contact, thereby securing the door in the closed position. When the blocking link is moved, as by a force exerted on an exit bar operably connected to the blocking link, the latch bolt is freed for rotation to the retracted position. Continued exertion of force against the exit bar or door forces the latch bolt to move past the frame bolt and the door to be opened. Upon removal of the force exerted on the exit bar, the latch bolt and blocking link return to their biased positions so that the latch bolt is again fixed in the extended position. As the door returns to the closed position, the latch bolt displaces the frame bolt inwardly and moves past the frame bolt. When the latch bolt moves past the frame bolt, the frame bolt is biased into the projected position wherein each bolt locking surface is in opposing surface-to-surface contact, securing the door in the closed position.

An object of the invention is to provide a new and improved latch assembly especially adapted for incorporation into an exit bar.

Another object of the invention is to provide a new and improved latch assembly which is reliable under intensive usage and provides a high level of security.

A further object of the invention is to provide a new and improved latch assembly which incorporates the reliability features of a rotary latch and the high security features of a sliding latch bolt.

Other objects and advantages of the invention will become apparent from the detailed description and the drawings.

DETAILED DESCRIPTION OF THE PREFERRED EMBODIMENT

Figure 1:
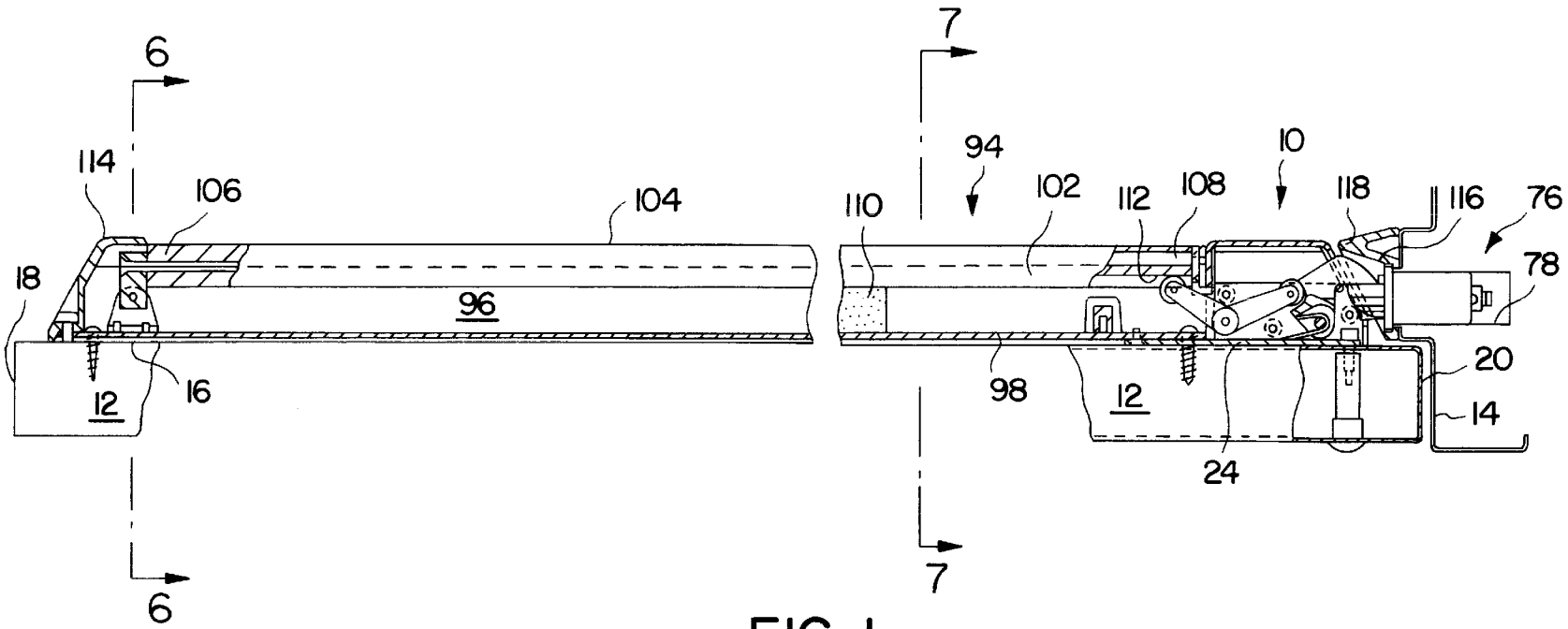
FIG. 1 is a top view, partly in section and partly broken away, of an exit bar latch assembly together with the associated door and door frame in accordance with one embodiment of the present invention.
Figure 2:
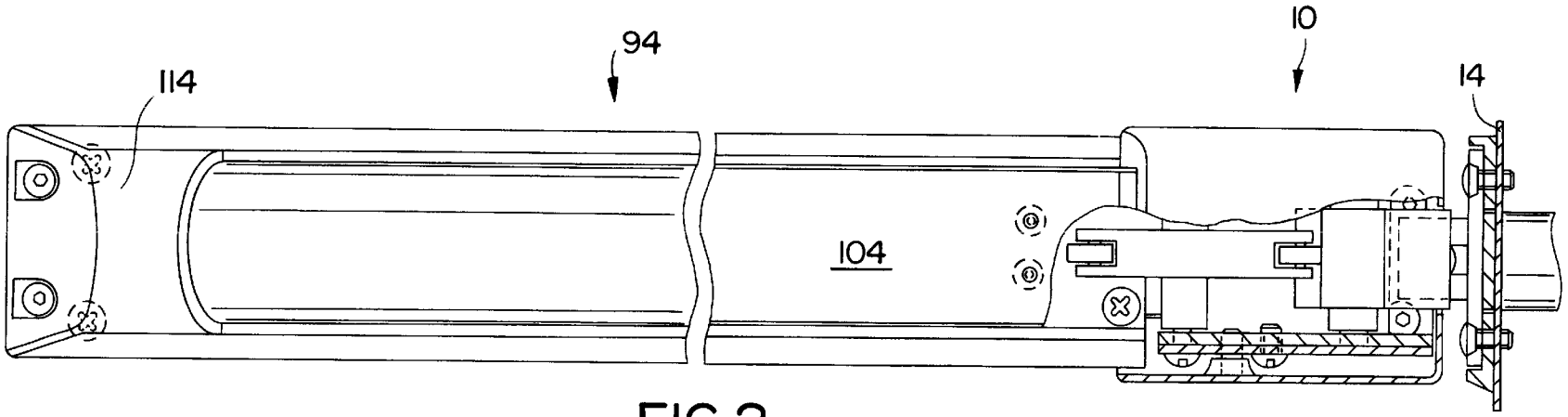
FIG. 2 is a side elevational view, partly broken away and partly in section, of the exit bar latch assembly of FIG. 1.
Figure 3:
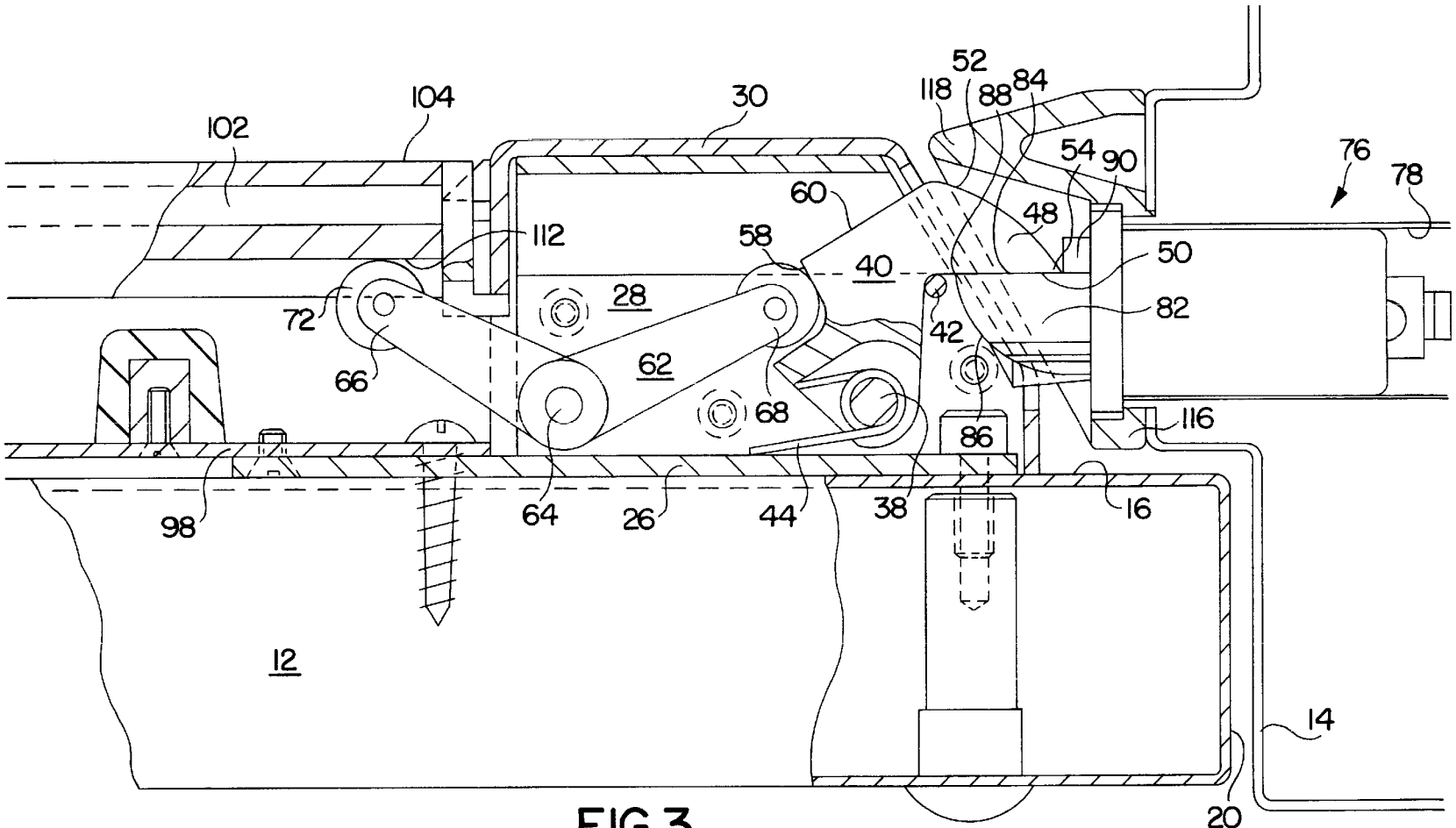
FIG. 3 is an enlarged view of a portion of the exit bar latch assembly of FIG. 1.

With reference to the drawings, wherein like numerals represent like components or structures throughout the figures, a latch assembly of the invention is generally represented by the numeral 10. The latch assembly is used in conjunction with a door 12 which is hingedly supported within a door frame 14 for pivotal movement between open and closed positions in a well known and conventional fashion. As shown in FIGS. 1–3, the latch assembly 10 is mounted to an interior (secured) side or face 16 of the door 12 to secure the door to the door frame in the closed position. For convenience, a direction parallel to the interior or secured side of the door 16 from a hinge edge 18 to a latch edge 20 will be referred to as a longitudinal direction and a direction perpendicular to the interior or secured face 16 of the door will be referred to as a transverse direction.

Figure 4:
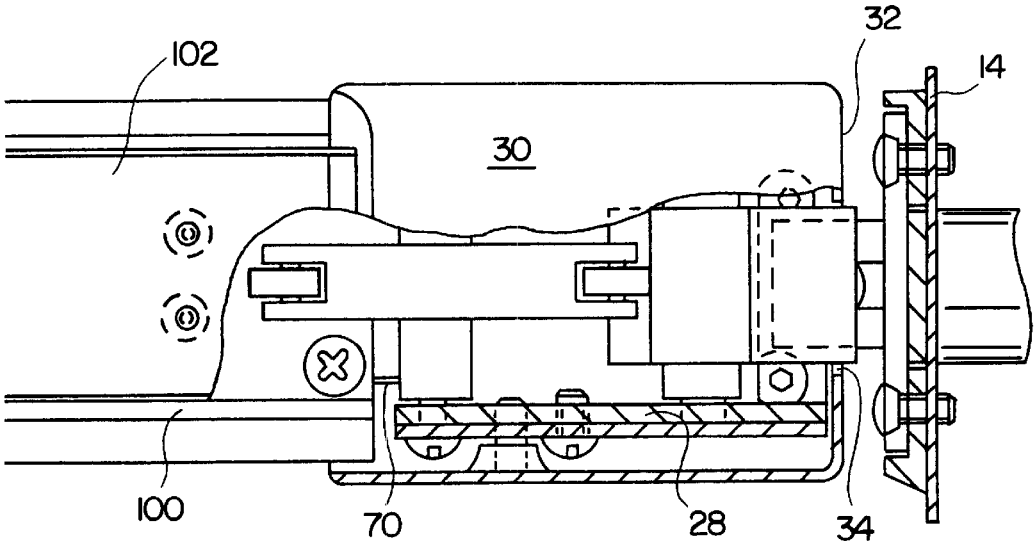
FIG. 4 is an enlarged view of a portion of the exit bar of FIG. 2.

As shown best in FIGS. 3 and 4, a latch assembly 10 comprises a frame 24 (FIG. 1), including a base 26. The frame base 26 is mounted to the secured side 16 of the door by fasteners such as screws or bolts. A pair of spaced walls 28 extend transversely from the frame base 26. A frame cover 30, best shown in FIG. 3, is mounted to the spaced walls 28 to thereby enclose the latch assembly. The cover 30 includes a cover face 32 adjacent the door latch edge 20 defining a latch bolt opening 34.

A latch bolt pin 38 is mounted to the spaced walls 28. A latch bolt 40 is mounted to the latch bolt pin 38 for limited pivotal movement about an axis. Latch bolt pivotal movement is limited in the clockwise direction (with reference to FIGS. 1 and 3) by a stop pin 42 mounted to the frame 24. Contact of the latch bolt 40 with the stop pin 42 defines a latch bolt extended position. The latch bolt 40 is biased toward the extended position by a spring 44. Preferably, the spring 44 is a torsion spring surrounding the latch bolt pin 38, with a first end engaging the latch bolt 40 and a second end engaging the frame base 26. The latch bolt 40, when not blocked as later described, may pivot against the bias in a counterclockwise direction to a retracted position.

The latch bolt 40 comprises a tip portion 48, which in the extended position projects from the cover opening 34. The latch bolt defines a number of surfaces which are important to the locking function. The extended latch bolt tip portion 48 comprises a planar locking surface 50, facing and substantially parallel with the door secured side in the extended position. Transversely oppositely disposed of the locking surface 50 is a tapered or curved latch bolt engagement surface 52. The latch bolt engagement surface 52 may define an arc around the pivotal axis of the latch bolt. The latch bolt locking and engagement surfaces 50, 52 intersect at a latch bolt tip 54. A latch bolt shoulder 58 is disposed generally longitudinally opposite the latch bolt tip portion 48. Preferably, the shoulder 58 comprises two substantially planar faces intersecting at a radiused corner. A return cam surface 60 connects the latch bolt shoulder 58 and tapered engagement surface 52.

A blocking link selectively prevents movement of the latch bolt 40 from the extended position. Preferably the blocking link comprises a crank 62 mounted to a crank pin 64. The crank pin 64 is longitudinally spaced from the latch bolt pin 38 and is mounted to the spaced walls 28. The crank 62 includes first 66 and second 68 ends and is mounted to the crank pin 64 for limited pivotal movement between blocking and release positions. A spring 70 biases the crank 62 toward the blocking position. Preferably, the spring 70 is a torsion spring surrounding the crank pin 64 with a first end engaging the frame 24 and a second end engaging the crank 62. The crank is preferably integrally formed in a "V" shape. In this configuration, the crank first end 66 extends (relative to pin 64) generally away from the door latch edge 20 and angularly away from the door interior surface 16. The crank second end 68 extends (relative to pin 64) generally toward the door latch edge 20 and angularly away from the door interior surface 16.

In the blocking position, the crank second end 68 engages the latch bolt shoulder 58, preventing counterclockwise pivoting of the latch bolt 40 out of the latch bolt extended position. In the release position, the crank second end 68 is separated from the shoulder 58, allowing unhindered pivotal movement of the latch bolt 40 toward the retracted position. The crank first and second ends 66, 68 may incorporate anti-friction devices such as, for instance, rollers 72 to reduce friction during engagement.

Figure 5:
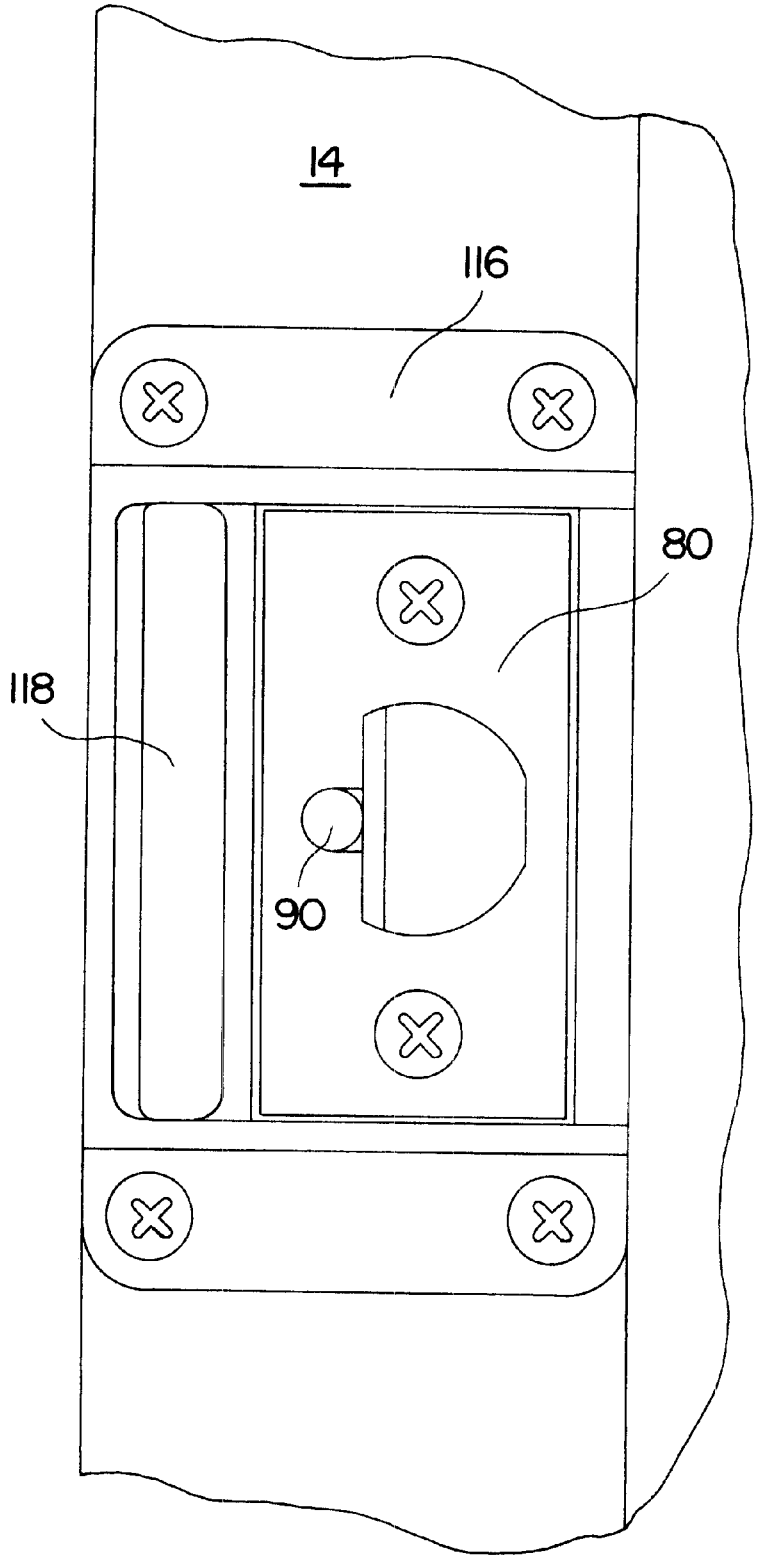
FIG. 5 is an enlarged fragmentary end view of an interior portion of the latch assembly of FIG. 1.
Figure 7:
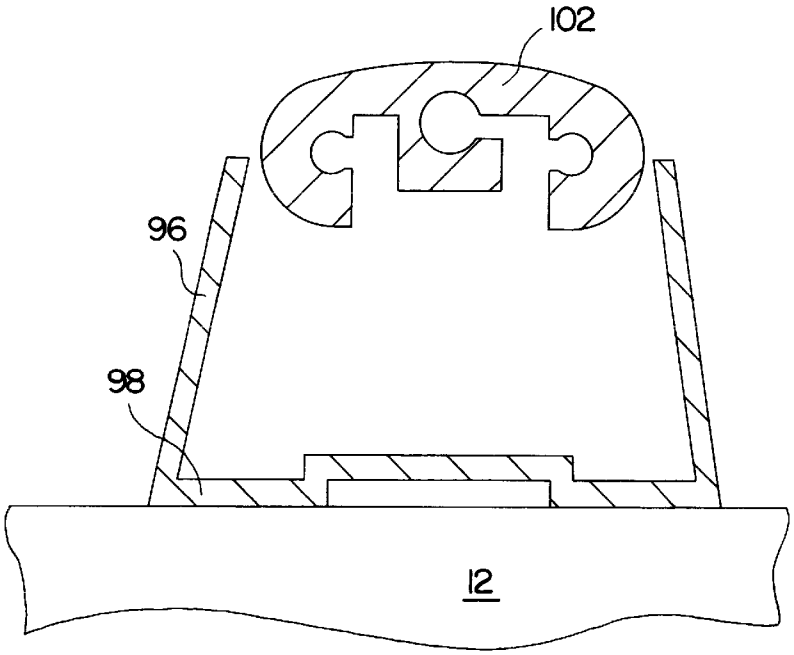
FIG. 7 is a sectional view of the latch assembly of FIG. 1 taken along the line 7—7 thereof.
Figure 6:
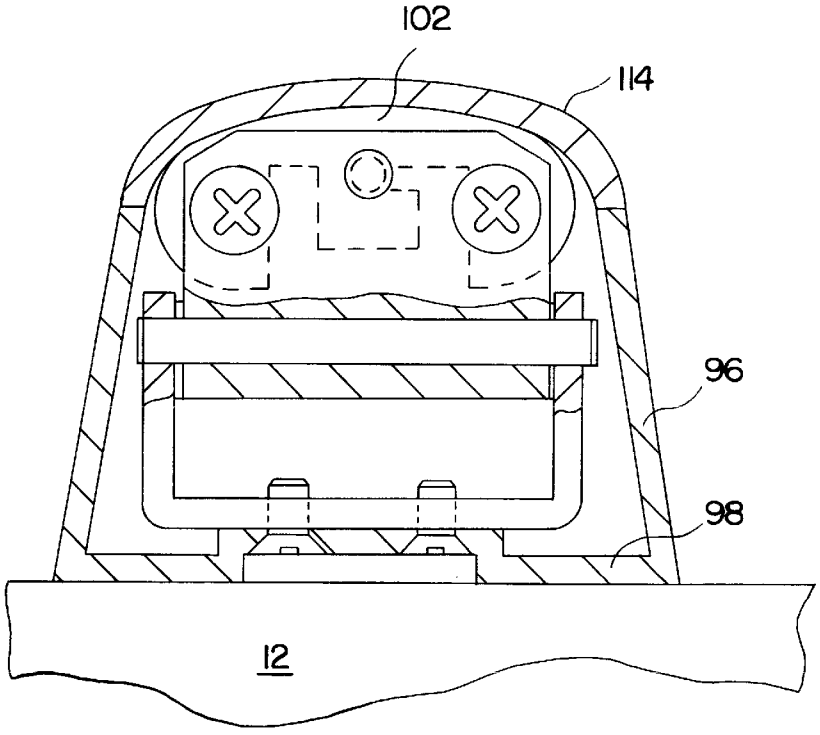
FIG. 6 is a sectional view of the latch assembly of FIG. 1 taken along the line 6—6 thereof.

The latch assembly 10 comprises a plunger assembly which, as shown in FIG. 1, is mounted within a bore 78 in the door frame 14. The plunger assembly has a first end facing the door edge 20 for engagement with the latch bolt 40 when the door 12 is in the closed position. With reference to FIG. 5, the plunger assembly may include a mounting panel 80 fixed adjacent the first end by which the plunger assembly 76 is mounted to the door frame using screws or other fasteners. As shown best in FIG. 3, the plunger assembly 76 comprises a frame bolt 82 extending from the first end for linear movement between a biased position projecting from the door frame 14 and an inward position displaced toward the door frame 14. The frame bolt 82 comprises a planar locking surface 84 transversely spaced from and generally parallel to the interior side 16 of the door in a closed position. The frame bolt 82 may also preferably comprise a tapered or curved engagement surface 86 disposed toward the interior face 16 of the door in the closed position. The frame bolt locking and engagement surfaces 84, 86 intersect at a frame bolt tip 88.

Preferably, the plunger assembly 76 also comprises a lock pin 90 extending from the plunger assembly first end and adjacent the frame bolt locking surface 84. The lock pin 90 is mounted for linear movement between a biased position projecting from the door frame 14 and an inward position displaced toward the door frame 14. In a conventional manner, the lock pin 90 in the biased projected position allows free linear movement of the frame bolt 82. When the lock pin 90 is displaced inwardly toward the door frame 14, the frame bolt 82 is fixed in the extended position. Thus, inward displacement of the lock pin 90 functions to secure the frame bolt 82 in the projected position.

With reference to FIGS. 1, 2, 6 and 7, an exit bar 94 is engageable with the latch assembly 10. The exit bar has an elongated housing 96 which provides the principal mounting and support structure. The length of the housing 96 is preferably sufficiently long to substantially span the width of the door 12. The housing 96 is mounted to the door 12 by screws or other fasteners which secure the back panel 98 of the housing 96 in surface-to-surface disposition to the interior or secured face 16 of the door. The housing 96 is channel-shaped with an elongated opening 100 of the channel being spaced away from the door 12. See FIGS. 2, 6 and 7. An end cap or cover 114 may be mounted to the exit bar 94 at an end opposite the latch assembly 10.

A push bar or pad 102 is located in the housing opening 100 and longitudinally spans a substantial portion of the housing 96. The push bar defines a push face 104 for receiving a push force exerted toward the door 12 by a person attempting to egress through the door. The push bar 102 is pivotally mounted to the housing 96 at a first end 106 displaced longitudinally from the latch assembly 10. The opposing second end 108 of the push bar, located adjacent the latch assembly 10, is mounted to the housing 96 for displacement against a bias in a direction substantially transversely toward the door 12. The push bar 102 may be biased away from the door secured side 16 in any well known manner, such as, for instance, by springs 110 positioned between the push bar 102 and housing 96. The push bar second end 108 defines an interior cam surface 112 for engagement with the crank first end 66.

While a detailed structure for the exit bar 94 has been set forth for purposes of illustration, it should be understood that the invention is not limited to the described exit bar structure and can find application with numerous other exit bar variations and devices. For example, the latch assembly 10 may also be advantageous in exit bars which comprise push bars mounted for transverse displacement at either the latch or opposing ends. Similarly, the inventive latch assembly may be advantageously used in exit bars which are actuateable by an electric signal generated at a remote location.

Figure 8:
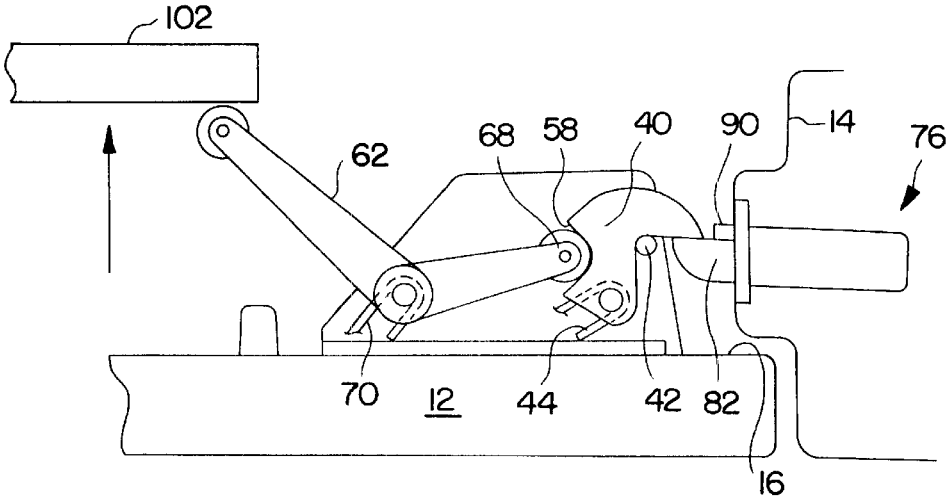
FIGS. 8–11 are schematic views, partly representational, illustrating the latch assembly of FIG. 1 as the door opens and closes.

With reference to FIG. 8, when the door 12 is in the closed position, the push bar 102 is biased transversely outwardly (with respect to the door); the crank 62 is biased by the crank spring 70 in a clockwise direction to the blocking position; and the latch bolt 40 is biased into the extended position abutting the stop pin 42 by the latch bolt spring 44. The latch bolt 40 is fixed in the extended position by engagement of the latch bolt shoulder 58 with the crank second end 68. The latch bolt and frame bolt planar locking surfaces 50 and 84 respectively, are engaged in adjacent, opposing surface-to-surface relationship. In this condition, the door 12 is prevented from further inward rotation by contact of the door secured side 16 with the door frame 14 and locked from outward rotation by engagement of the latch bolt and frame bolt locking surfaces 50, 84. The frame bolt 82 is fixed in the extended position by the inwardly displaced lock pin 90.

Figure 9:
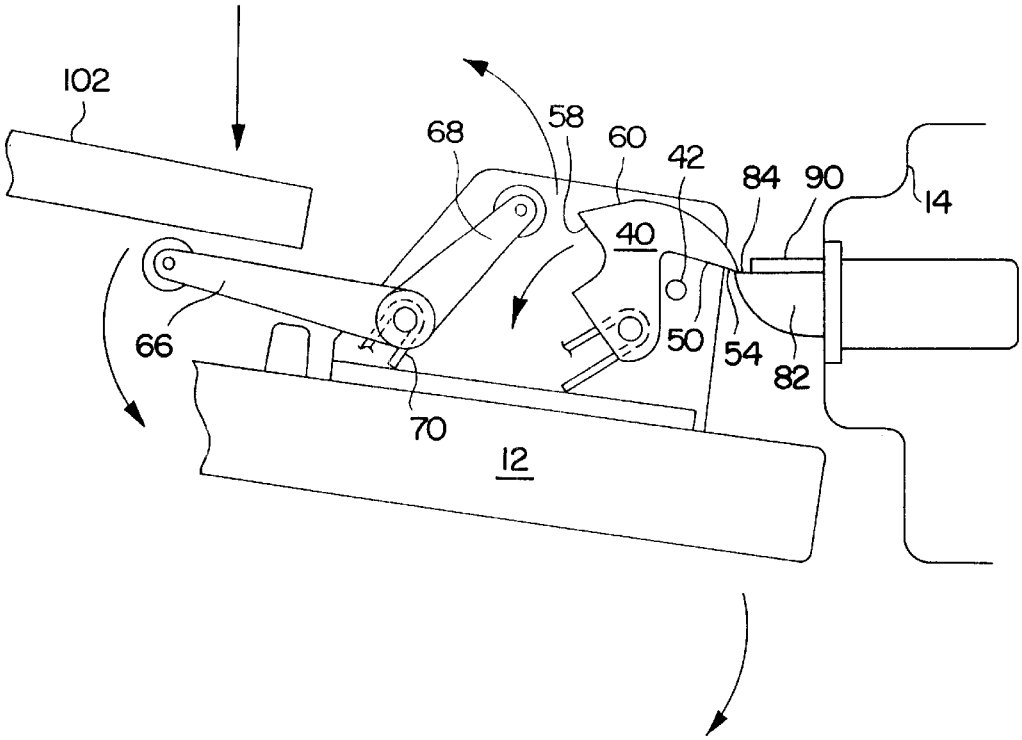

With reference to FIG. 9, displacement of the push bar 102 transversely inwardly, as by a person pushing against the push face, pivotally displaces the crank first end 66 in a counterclockwise direction. The crank first end displacement is transferred to the crank second end 68, which is pivotally displaced in a counterclockwise direction out of engagement with the latch bolt shoulder 58. Continued application of force against the push pad 102, or against the door interior face 16 in general, forces the latch bolt planar locking surface 50 against the frame bolt planar locking surface 84. This engagement pivots the freed latch bolt 40 in a counterclockwise direction, unlocking the door 12 and allowing the door to be rotated toward the open position.

As the door 12 rotates toward the open position, the latch bolt tip 54 moves away from the lock pin 90. When the latch bolt tip 54 has moved outward of the frame bolt tip 88, the lock pin 90 is biased longitudinally outwardly from the door frame 14, allowing subsequent free movement of the frame bolt 82.

Upon release of the push bar 102, the push bar is biased transversely outwardly. This allows clockwise pivotal movement of the crank first and second ends 66, 68 toward the blocking position under the influence of the crank spring 70. Simultaneously, the latch bolt 40 is pivoted in a clockwise direction toward the extended position abutting the stop pin 42 by the influence of the latch bolt spring 44. The latch bolt return cam surface 60 interacts with the crank second end 68 to ensure full pivotal movement of the latch bolt 40 to the extended position is not hindered. Thus, as soon as the push bar 102 is released, the latch bolt 40 pivots to the extended position and is locked therein by the crank second end 68 engaging with the latch bolt shoulder 58 upon pivotal movement of the crank 62 into the blocking position.

Figure 10:
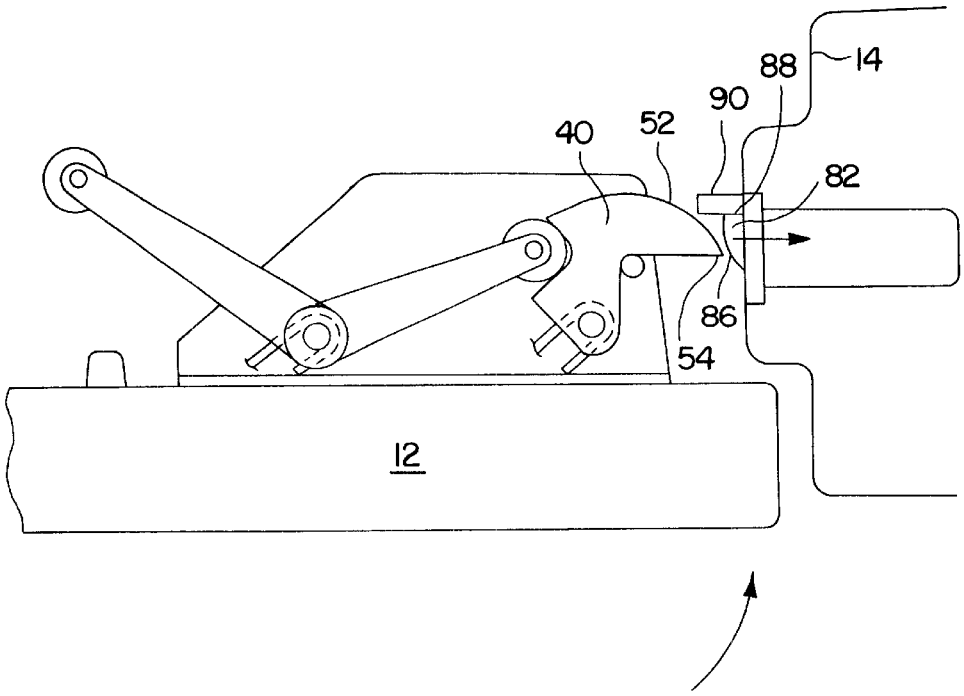
Figure 11:
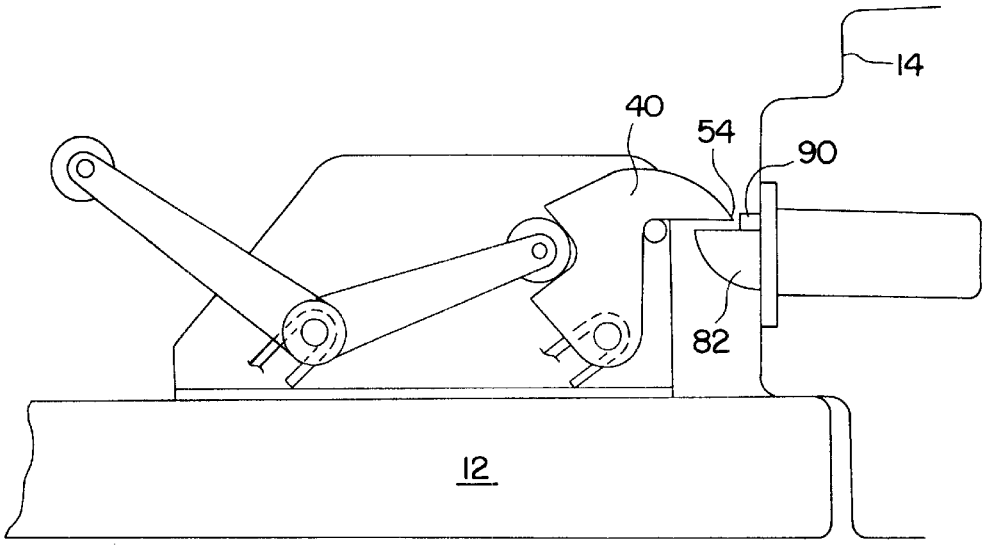

With reference to FIGS. 10 and 11, as the door 12 is moved toward the closed position, the latch bolt engagement surface 52 contacts the frame bolt engagement surface 86. As the door 12 continues movement toward the closed position, the blocked latch bolt 40 linearly displaces the frame bolt 82 toward the door frame 14, allowing the latch bolt engagement surface 52 to ride over the frame bolt engagement surface 86. As the door 12 moves into the closed position, the latch bolt tip 54 rides past the frame bolt tip 88, allowing the frame bolt 82 to be biased back to the projected position. The lock pin 90 is inwardly displaced by contact with the latch bolt tip 54, fixing the frame bolt 82 in the projected position.

It should be noted that the transversely oriented engagement of the bolt locking surfaces 50, 84 prevents transverse forces applied to the door 12 from being transferred to the frame bolt 82 as a longitudinal force component and thereby linearly displacing the frame bolt 82.

A jamb plate 116 preferably surrounds the frame bolt 82 as shown best in FIGS. 3 and 5. The jamb plate 116 may be integral with the plunger assembly 76 or a separate part mounted to the door frame 14 independently of the plunger assembly 76 in any well known manner. Preferably the jamb plate 116 is adapted for mounting between the door frame 14 and the plunger assembly mounting panel 80. The jamb plate 116 includes an extension 118 extending longitudinally from the door frame 14 toward the cover 30. When the door 12 is in the closed position, the jamb plate extension 118 acts as a cosmetic cover and also restricts access to the latch bolt 40 and frame bolt 82. The jamb plate 116 also acts as a guard preventing persons exiting the open doorway from contacting the projecting frame bolt 82.

The invention provides a latch assembly 10 of extremely efficient construction which retains the desirable wear characteristics of conventional rotary type latch bolts. Despite the extremely efficient construction and desirable wear characteristics, the inventive latch assembly 10 provides a doorway with burglary and static pressure resistance which is substantially limited only by the strength of the frame 14 and door 12. The design of the crank 62 and engagement of the crank 62 with the push bar 102 and latch bolt 40, allows a force well below that required by codes to disengage the latch bolt 40, and allow the door 12 to be opened. Further, the inventive latch assembly allows use with push pads of any size or type.

While a preferred embodiment of the foregoing invention has been set forth for purposes of illustration, the foregoing description should not be deemed a limitation of the invention herein. Accordingly, various modifications, adaptations and alternatives may occur to a person of ordinary skill in the art, without departing from the spirit or scope of the present invention.

What is claimed is:

1. A latch assembly, comprising:

a latch frame mounted in fixed relationship to a door and having a latch face defining an opening;

a latch bolt comprising a locking surface mounted to said frame for pivotal movement between a position projecting through said opening and a position retracted from said opening;

means for biasing said latch bolt toward said extended position; and a frame bolt comprising a locking surface projectable from a door frame;

a blocking link moveable to a blocking position wherein said latch bolt is secured in said extended position, and said blocking link comprises a crank defining first and second ends, said crank pivotally mounted to said latch frame at a crank axis intermediate said ends, displacement of said first crank end toward said door pivoting said crank second end from said blocking position wherein the latch bolt is free to pivot from said extended position to clear the frame bolt and permit movement of the door toward an open position;

wherein when said door is in a closed position relative to said door frame, said locking surfaces are engaged in adjacent, opposing surface-to-surface relationship.

2. The latch assembly of claim 1 wherein said frame bolt locking surface faces away from a secured side of said door when said door is in said closed position.

3. The latch assembly of claim 1 wherein said latch and frame bolts have each an engagement surface and one said engagement surface is tapered so that when the door is moved toward the closed position the engagement surfaces engage and ride over each other.

4. The latch assembly of claim 1 comprising means for preventing movement of said latch bolt from said extended position in a first pivotal direction.

5. The latch assembly of claim 4 comprising means for selectively preventing movement of said latch bolt from said extended position in a second pivotal direction.

6. A latch assembly for selectively securing a door mounted to a door frame, comprising:

a latch frame mounted in fixed relationship to a secured side of said door and comprising a latch face defining an opening;

a latch bolt pivotally mounted to said latch frame for movement between extended and retracted positions, a latch bolt portion projectable through said opening in said extended position, said latch bolt portion defining a generally planar locking surface facing said door secured side and an opposing tapered engagement surface;

a spring for biasing said latch bolt toward said extended position; and a frame bolt with opposing engagement and generally planar locking surfaces projecting from said door frame;

wherein when the door is moved toward a closed position, the engagement surfaces contact and ride over each other so that in said closed position, said locking surfaces are engaged in adjacent, opposing surface-to-surface relationship and further including a blocking link moveable to a blocking position wherein said latch bolt is secured in said extended position, and said blocking link comprises a crank defining first and second ends, said crank pivotally mounted to said latch frame at a crank axis intermediate said ends, displacement of said first crank end toward said door pivoting said crank second end from said blocking position wherein the latch bolt is free to pivot from said extended position to clear the frame bolt and permit movement of the door toward an open position.

7. The latch assembly of claim 6 wherein said crank has an integrally formed V-shape.

8. The latch assembly of claim 6 comprising a crank spring surrounding said crank axis for pivotally biasing said crank to said blocking position.

9. The latch assembly of claim 6 wherein said latch bolt defines a shoulder for blocking engagement with said crank second end.

10. A latch assembly of claim 6 wherein said latch bolt is mounted to define a latch bolt pivotal axis and said latch bolt engagement surface defines an arc about said latch bolt axis.

11. The latch assembly of claim 6 comprising a plunger assembly mounted to said door frame, said frame bolt displaceably mounted in said plunger assembly for linear movement between a biased position projecting from said door frame and a position inward of said projected position toward said door frame.

12. The latch assembly of claim 11 comprising a lock pin displaceably mounted in said plunger assembly adjacent said frame bolt planar surface for movement between a biased position projecting from said door frame and a position inward of said projected position toward said door frame, said lock pin fixing said frame bolt in said projecting position when said lock pin is in said inward position and allowing movement of said frame bolt to said inward position when said lock pin is in said projected position.

13. The latch assembly of claim 12 wherein said latch bolt locking and engagement surfaces intersect at a tip, said tip displacing said lock pin to said inward position when said door is in said closed position.

14. The latch assembly of claim 12 comprising a jamb plate mounted to said door frame, said jamb plate spanning a distance between said door frame and said latch frame when said door is in said closed position.

15. An exit bar for releasably securing a door to a door frame, comprising:

a housing assembly mounted to a secure side of said door including a latch face defining an opening;

a latch assembly comprising:

a latch bolt with a blocking shoulder pivotally mounted to said housing for movement between extended and retracted positions, a portion projectable through said opening in said extended position, said portion in said extended position defining a generally planar locking surface substantially parallel with said door secured side and an opposing tapered engagement surface, a stop pin abutting said latch bolt locking surface in said extended position, said stop pin preventing movement of said latch bolt from said extended position in a first pivotal direction, a spring for biasing said latch bolt in said first pivotal direction toward said extended position, a crank defining first and second ends, said crank pivotally mounted at a crank axis intermediate said ends to said housing assembly, said crank second end engageable with said blocking shoulder to prevent movement of said latch bolt from said extended position in a second pivotal direction opposite said first pivotal direction, a spring for biasing said crank in said first rotational direction, a plunger assembly mounted to said door frame, a frame bolt with opposing engagement and planar locking surfaces displaceably mounted within said plunger assembly, said plunger assembly linearly displaceably inwardly toward said door frame from a biased position projecting from said door frame, wherein when the door is moved toward a closed position the engagement surfaces contact and ride over each other, displacing said frame bolt inwardly so that when said door is in said closed position said locking surfaces are engaged in adjacent, opposing surface-to-surface relationship; and a push bar mounted for displacement relative to said housing assembly, displacement of said push bar pivoting said crank in said second pivotal direction and pivoting said crank second end out of engagement with said blocking shoulder, wherein a force applied to said door secured side forces said latch bolt locking surface against said frame bolt locking surface pivoting said latch bolt in said second pivotal direction to clear the frame bolt and permit the door to open.

16. The exit bar of claim 15 wherein said latch bolt defines a cam surface between said blocking shoulder and said engagement surface, said cam surface engaging said crank second end to pivot said crank in said second pivotal direction when said latch bolt pivots in said second pivotal direction.

17. The exit bar of claim 15 wherein said crank axis, said crank second end and said blocking shoulder are linearly aligned when said crank second end is engaged with said blocking shoulder.

18. The exit bar at claim 17 wherein said latch bolt pivotal movement, said crank pivotal movement and said plunger displacement are substantially all in the same plane.

* * * * *